US007100213B2

(12) United States Patent
Krautbauer

(10) Patent No.: US 7,100,213 B2
(45) Date of Patent: Sep. 5, 2006

(54) UNDERGARMENT SYSTEM

(76) Inventor: Robert A. Krautbauer, 9750 Orchard Rd., Colonge, MN (US) 55322

( * ) Notice: Subject to any disclaimer, the term of this patent is extended or adjusted under 35 U.S.C. 154(b) by 50 days.

(21) Appl. No.: 10/933,755

(22) Filed: Sep. 3, 2004

(65) Prior Publication Data

US 2005/0050616 A1 Mar. 10, 2005

Related U.S. Application Data

(60) Provisional application No. 60/500,758, filed on Sep. 5, 2003.

(51) Int. Cl.
*A41B 9/02* (2006.01)

(52) U.S. Cl. ..... 2/403; 2/400; 602/70; 602/67

(58) Field of Classification Search ..... 2/400–408, 2/227, 228, 238; 602/67–72; 604/385.01–396; 450/99–105, 155, 96, 97
See application file for complete search history.

(56) References Cited

U.S. PATENT DOCUMENTS

| | | | | | |
|---|---|---|---|---|---|
| 496,747 | A | | 5/1893 | Polack | |
| 763,683 | A | | 6/1904 | Magoris | |
| 850,298 | A | | 4/1907 | De Mars | |
| 1,319,580 | A | | 10/1919 | Guild | |
| 1,362,908 | A | * | 12/1920 | Weisert | 2/402 |
| 1,477,187 | A | * | 12/1923 | Rayne | 602/71 |
| 2,027,622 | A | | 1/1936 | Stam | |
| 2,099,541 | A | | 11/1937 | Spain | |
| 2,505,356 | A | | 4/1950 | Goldstein | |
| 3,037,503 | A | | 6/1962 | Ravaschieri | |
| 3,094,990 | A | * | 6/1963 | Neilson | 2/400 |
| 3,116,736 | A | | 1/1964 | Alberts | |
| 3,208,454 | A | | 9/1965 | Farkas | |
| 3,518,995 | A | | 7/1970 | Claff | |
| 3,621,846 | A | | 11/1971 | Lehman | |
| 3,774,241 | A | * | 11/1973 | Zerkle | 2/67 |
| 4,413,624 | A | | 11/1983 | Snow | |
| 4,471,772 | A | | 9/1984 | Miller, Jr. | |
| 4,475,910 | A | | 10/1984 | Conway et al. | |
| 4,553,968 | A | | 11/1985 | Komis | |
| 4,587,675 | A | | 5/1986 | Prouty | |
| 4,622,962 | A | * | 11/1986 | Kauffman | 602/70 |
| 4,640,688 | A | | 2/1987 | Hauser | |
| 4,713,067 | A | | 12/1987 | Rothenberg et al. | |
| 4,932,079 | A | | 6/1990 | Bridgewater | |
| 4,942,885 | A | | 7/1990 | Davis et al. | |
| 4,961,419 | A | | 10/1990 | Tribble et al. | |
| 5,036,839 | A | | 8/1991 | Weiss et al. | |
| 5,226,179 | A | | 7/1993 | Choi | |
| 5,237,706 | A | * | 8/1993 | Nalbandian | 2/403 |
| 5,797,401 | A | | 8/1998 | Knight | |
| 5,876,395 | A | * | 3/1999 | Hart et al. | 604/393 |
| 5,974,592 | A | | 11/1999 | Tabrizi | |
| 6,038,703 | A | | 3/2000 | Chung | |
| 6,061,840 | A | | 5/2000 | Alligator | |
| 6,159,070 | A | * | 12/2000 | Schwartz et al. | 450/155 |
| 6,295,651 | B1 | | 10/2001 | Kang | |
| 6,353,940 | B1 | | 3/2002 | Lyden | |
| 6,406,462 | B1 | | 6/2002 | Johnson | |
| 6,412,119 | B1 | | 7/2002 | Robles | |

* cited by examiner

*Primary Examiner*—Gloria M. Hale
(74) *Attorney, Agent, or Firm*—Westman, Champlin & Kelly, P.A.

(57) ABSTRACT

An underwear system has a basic support structure comprising a waistband supporting a pair of leg straps that cross in the crotch region, and provide for openings at the front and rear, defined by the leg straps. The leg straps also define side openings on which leggings can be supported. Various attachments can be secured to the basic leg strap structure for protecting both female and male bodily parts.

10 Claims, 6 Drawing Sheets

FIG. 10
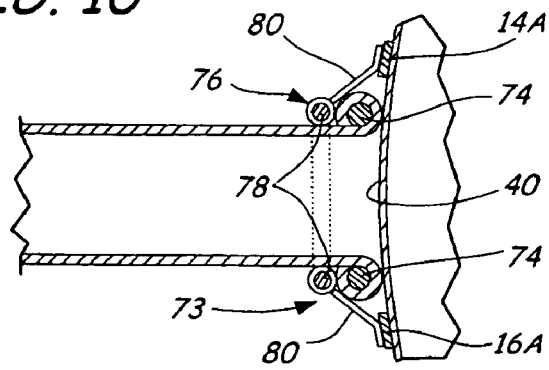
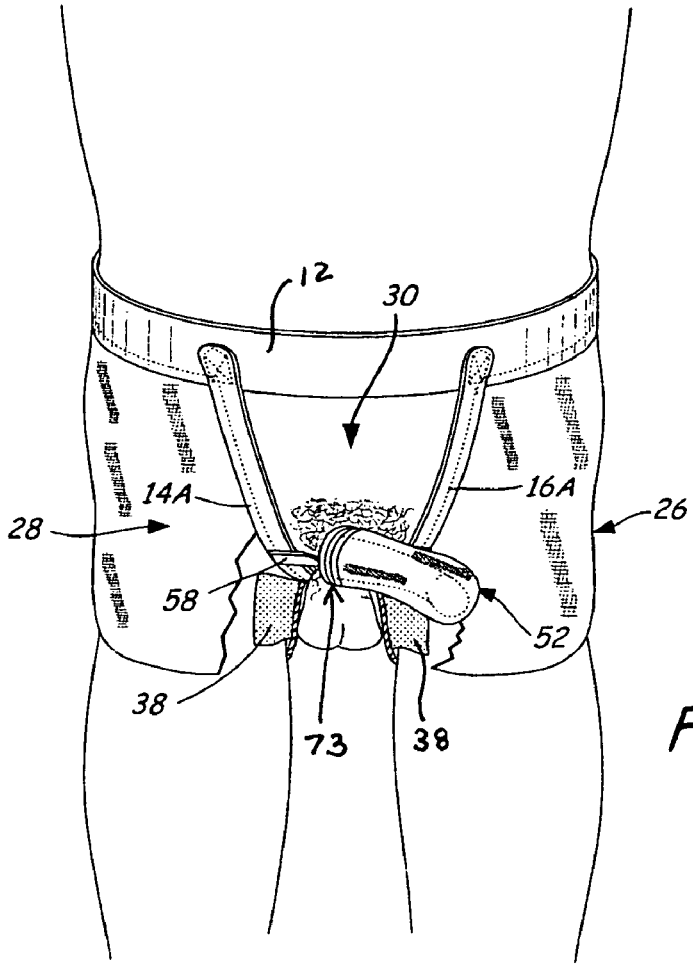
FIG. 12

UNDERGARMENT SYSTEM

The present application is based on and claims the benefit of U.S. provisional patent application Ser. No. 60/500,758, filed Sep. 5, 2003, the content of which is hereby incorporated by reference in its entirety.

BACKGROUND OF THE INVENTION

The present invention relates to articles of apparel, and in particular, to underwear which are suitable for use by male and female wearers.

Men and women's undergarments are frequently restrictive and retain and contain the heat generated by the body causing dampness due to perspiration.

In addition, undergarments that elevate and press the male reproductive organs against the pubic area of the torso are believed to adversely influence the production and operation of sex hormones and anabolic metabolism with respect to the process of adaptation and acquisition of athletic fitness. Associated with this is lower sperm counts or less viable sperm being produced.

SUMMARY OF THE INVENTION

The present invention includes a support structure for an undergarment onto which portions of the undergarment are attached and that cover portions of the human body, the support structure comprising a waistband having a forward side and a rearward side, and at least two leg straps fastened to the forward side of the waistband, the leg straps extending downwardly from the forward side of the waistband and joined proximate a crotch area of the human body, and each leg strap extending upwardly and fastened at spaced apart positions to the rearward side of the waistband.

BRIEF DESCRIPTION OF THE DRAWINGS

FIG. 10 is a schematic sectional view illustrating the form of the covering attachment shown in FIG. 9;

FIG. 12 is a front view of the garment system of FIG. 11 with portions broken away to show extra padding in place;

DETAILED DESCRIPTION OF THE PREFERRED EMBODIMENTS

The present invention includes men's undergarments that permit the male reproductive organs to be suspended naturally but separated from the rest of the torso by leggings and any additional padding associated with the leggings. The present invention will lower the temperature to which the testes are subjected thereby increasing the rate and quality of spermatogenesis, and facilitating greater heat dissipation. This characteristic is believed to facilitate optimal thermoregulation. In addition, the preferred men's underwear of the present invention is believed to positively influence the effect of sex hormones and positively influence metabolism.

Figure 1:
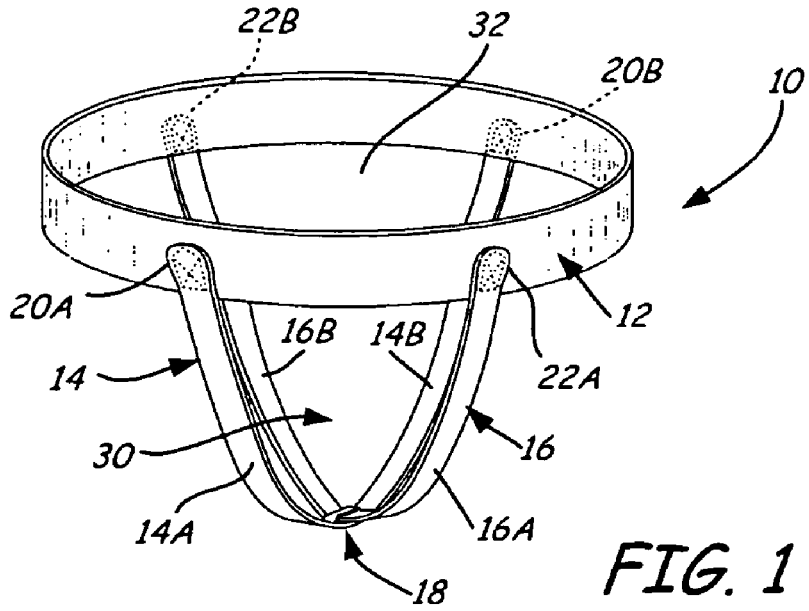
FIG. 1 is a perspective view of a front side of a basic structure for the undergarment system of the present invention.
Figure 2:
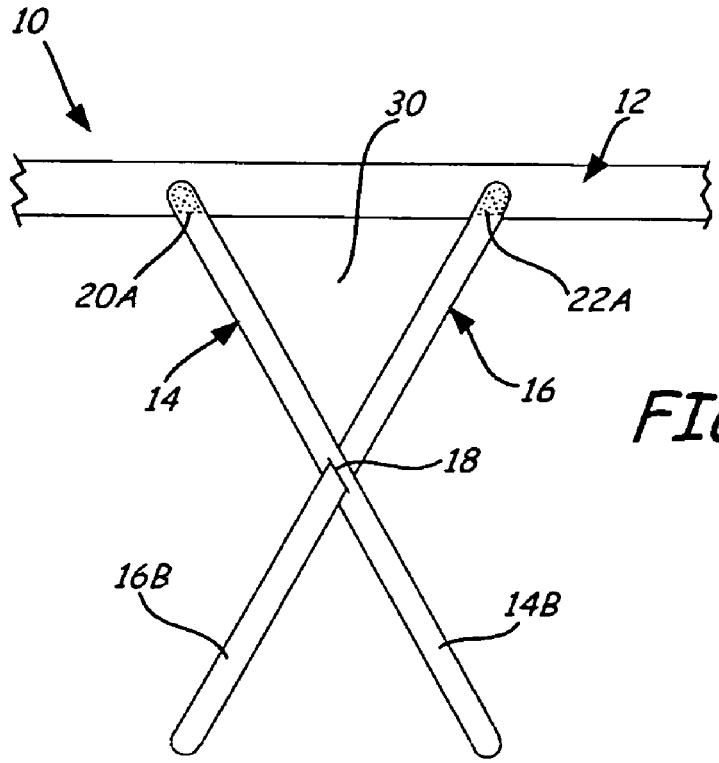
FIG. 2 is a schematic view thereof in a flat layout form for illustrative purposes.
Figure 3:
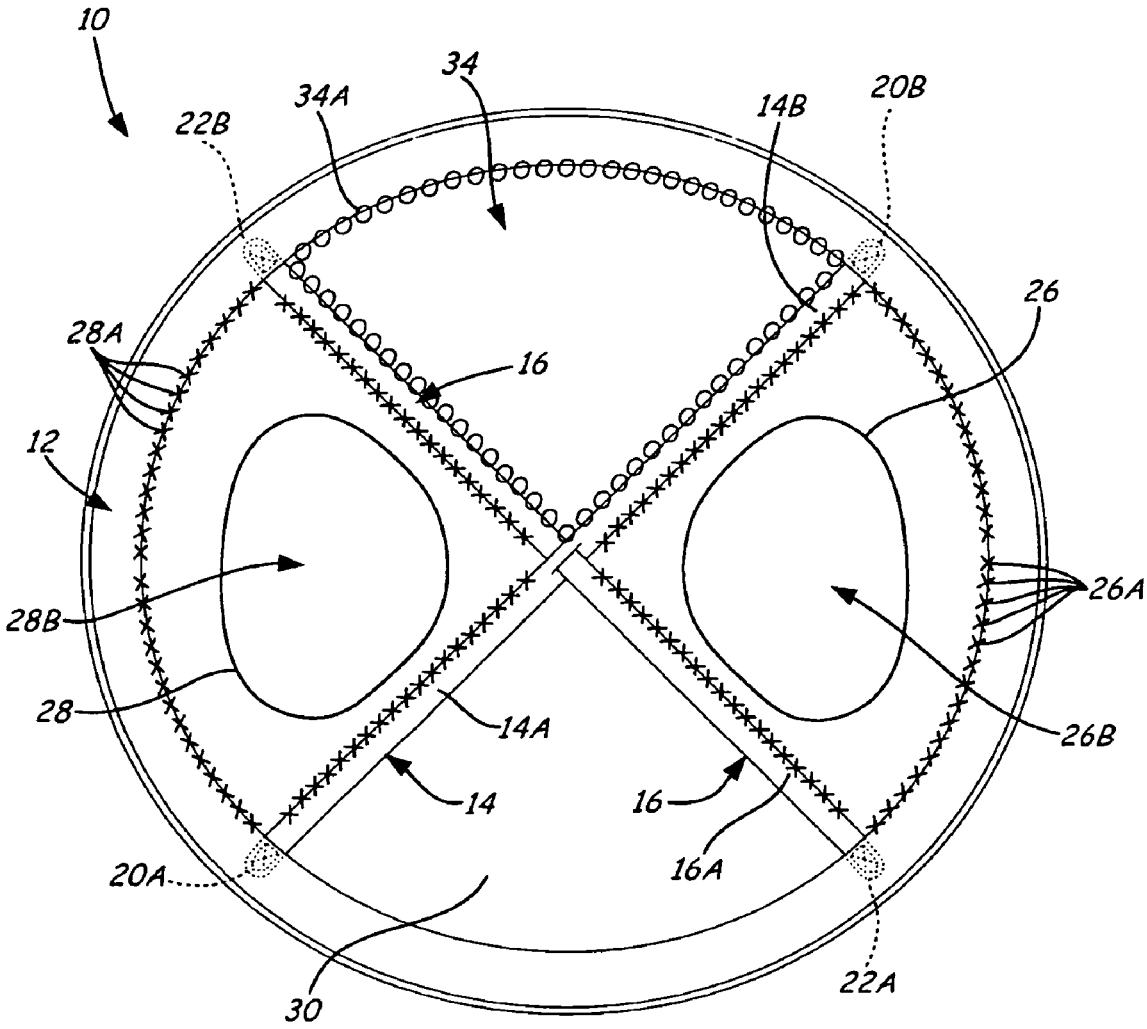
FIG. 3 is a top view thereof, with additional leggings shown in place.

FIGS. 1, 2, and 3 show a basic undergarment structure made according to the present invention, which is illustrated generally at 10, and forms a support for various modifications as will be described. The basic structure 10 includes a waistband 12 made of suitable material that may or may not have elastic portions, or can be all elastic, and a system of leg bands or straps, including leg bands or straps 14, and 16, which have front strap portions 14A and 16A, and rear strap portions 14B and 16B that are attached at their opposite ends to the waistband 12. The straps (or bands) 14 and 16 from the waistband, and in the form shown specifically, intersects (either under, over or through) in a crotch or center region indicated at 18. This means that the one strap section 14A of the strap 14 at the front intersects with the strap 16, (either under, over or through) and strap section 14B then travels upwardly at the rear to be fastened at 20B (first end is fastened at 20A) to the waistband. The front section 16A of the strap 16 is attached at 22A (spaced from 20A) to the waistband 12 at the front, and crosses over in the crossover crotch section 18, and the section 16B, which is at the rear, is attached at 22B (spaced from 20B) to the waistband 12 at the rear.

This is illustrated schematically in FIG. 2, as well, where the waistband 12 is shown in flat layout (but is broken off) and the attachment points of 22A and 20A for the straps 14 and 16 are illustrated. The waistband may be made as one continuous band or it may be made to allow it to open anywhere such as in the front, back or side. If the waistband is made to open, it could use methods to fasten into a continuous waistband that would include but not be limited to lacing, snapping, hooking, buckling or buttoning.

The crossover crotch section 18 can be formed and stitched together, or it can be seen that the straps can be made so that instead of crossing, the strap 16 would be fastened at crotch section 18 and merely bend away from the fastening, without crossing so that the strap section 14B could actually be a section of strap 16 in the position of section 14B. The leg strap 14 would be bent back as well and would be in the position of strap section 16B, the straps 14 and 16 are joined together at the center crotch section 18 in either configuration.

The leg straps 14 and 16 can be made of any suitable material, stretchable or non-stretchable material that is comfortable and does not irritate the skin. The waistband 12 of course can be made in various sizes, and the length of the leg straps 14 and 16 can be varied for different wearers. The leg straps may be attached at locations 20A and 20B, and 22A and 22B by stitching, lacing, snaps, Velcro® (hook and loop) fasteners, or other securing devices as desired. Normally, the straps are stitched in place, as is the center crotch section 18 where the straps 14 and 16 meet or cross.

As shown in FIG. 3, the waistband is illustrated in relatively wide configuration, and the leg straps 14 and 16 and their sections 14A, 14B, 16A, and 16B are illustrated as a top view. The locations 20A, 20B, 22A and 22B are shown in dotted lines.

In the suggested method the leg straps 14, 16 meet behind the scrotum and pass over the buttocks. The second ends of the leg straps 14 and 16 are attached to the backside of the waistband 12 at spaced locations 20B and 22B. The leg straps, again, cross, or are attached together so they fit between the legs below the torso.

Leggings 26 and 28 are illustrated in FIG. 3. An option of the present invention includes a legging structure that surrounds each leg to form a barrier between the legs and the scrotum. This barrier would serve to block the heat and sweat generated by the torso from the scrotum. Lowering the heat around the scrotum promotes comfort and increases the health of the male reproduction system housed inside the scrotum.

The leggings 26, 28 are attached along the front leg opening strap sections that are attached to the front side of the waistband 12 and follow up the backside leg strap sections on the rear side of the waistband. The leggings would depend from the waistband and leg opening straps and surround the respective leg. The leggings 26, 28 would be available in varying lengths depending on the desires of the wearer.

When the system is viewed from the front with the leggings 26, 28 attached, a triangular area formed by the waistband is viewable and the leggings 26, 28 that would be uncovered on the front side, exposing the stomach, the penis and scrotum area. An open triangular area exists on the backside, leaving the anal region as well as major portions of the buttocks uncovered.

The leggings 26 and 28 are made of suitable fabric and have upper edges that are stitched to the waistband 12 as represented by a series of x's indicated at 26A and 28A, respectively. The stitching may also lie along the leg strap sections 16A and 14B, and 14A and 16B.

Figure 4:
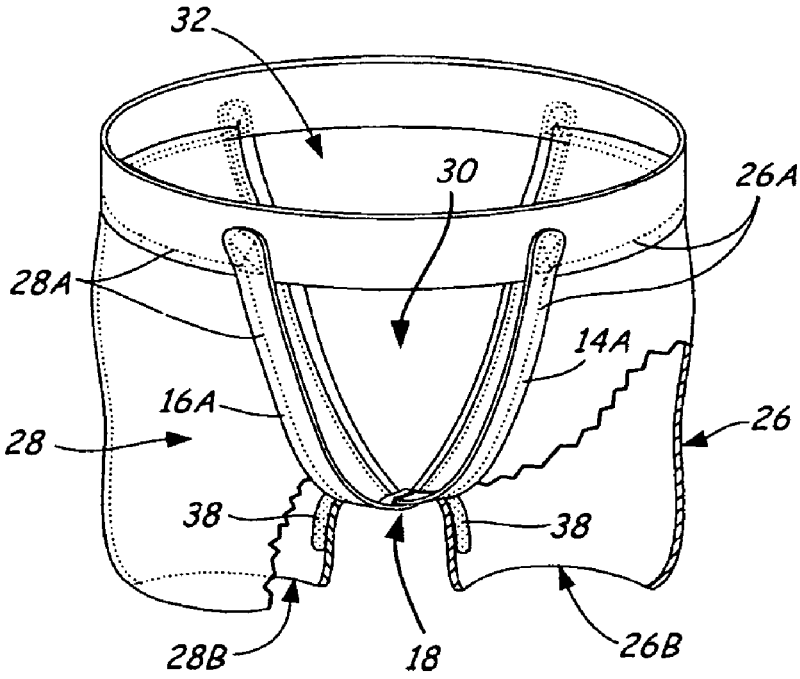
FIG. 4 is a partial perspective view of an undergarment system made according to the present invention showing an option of leggings in place with portions broken away.

The leggings 26 and 28 have leg openings illustrated schematically at 26B and 28B. The leggings 26, 28 form a V-shaped open area or opening 30 at the front, and a V-shaped open area trianugular or opening 32 at the back, as shown in FIG. 4. The triangular shape formed by the waistband 12 and the leg opening straps 14, 16 at the rear could alternatively be used to support a back panel 34 that would cover the entire backside of the wearer, covering the buttocks, thus eliminating the open backside triangular opening 32.

Figure 5:
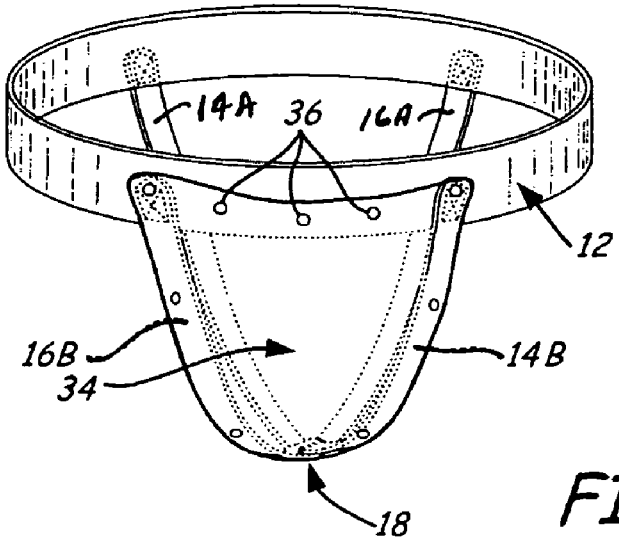
FIG. 5 is a rear view of the undergarment system illustrating an optional covering panel in place at the rear.

The back panel 34 as illustrated in FIGS. 3 and 5 is an option to cover the triangular area (opening 32) that is formed between the waistband and the leg opening straps on the backside of the basic structure. The back panel 34 or covering could be permanently attached to the leg straps 14, 16 and the waistband 12 or be made detachable at the top or the bottom allowing one to uncover the anal area without lowering the waistband.

The open front triangular area 30 leaves the scrotum and the penis on the males and the vagina on a woman uncovered. The opening 30 also could be covered with one continuous panel, which may be preferred if worn by a woman. A cover panel (not illustrated) for a male would preferably include an opening to allow the male wearer's penis to pass through when desired for urination or for any other reason so that the wearer may have to access the penis without lowering the waistband. The front opening cover panel (not illustrated) also could be permanently attached or made as a panel that could be detached at the top, the bottom or completely removable to permit uncovering the underlying skin and organ area without lowering the waistband 12.

The back panel 34 can be stitched as illustrated at 34A along the edges or onto the waistband 12, as well as the leg strap sections or portions 16B and 14B as illustrated in FIG. 3. The back panel 34 can also be made removable, with suitable fasteners 36 as shown in FIG. 5. The fasteners 36 can be snaps, lacing, Velcro® (hook and loop) fasteners, or other similar fasteners that would permit removal of the back panel 34 to leave the open area 32 open.

In FIG. 4, the leggings 26, 28 are illustrated with portions broken away, so that pads 38 on the interior side of the leggings 26, 28 are viewable. The additional padding 38 is provided on opposite sides of the junction 18, to accommodate absorption of perspiration, and the like. The pads would preferably start about the base of the penis and extend down the leg beyond the scrotum. The pads 38 serve as a method to draw additional perspiration away from the crotch area. The additional padding serves to help keep the scrotum cooler. Some of the methods for holding the pads 38 in place could be sewn pockets positioned on the inside of the legging structure for the pads to slip into and be held in the area between the legs and next to the scrotum, or the pads could have a fastening system of their own such as snaps, hooking, buttoning, Velcro® (hook and loop) fasteners or lacing. The legging and pad option could be the only options added to the basic system bands or could be combined with one or more of the other options of the system as described further.

The leggings 26 and 28 can be made of a material that will insulate the heat generated by the legs, as well as draw moisture away from areas that perspire. The exact material used for the legging would preferably be any desired absorbent material, and the additional pads 38 can also be made to be absorbent for absorbing moisture.

Figure 11:
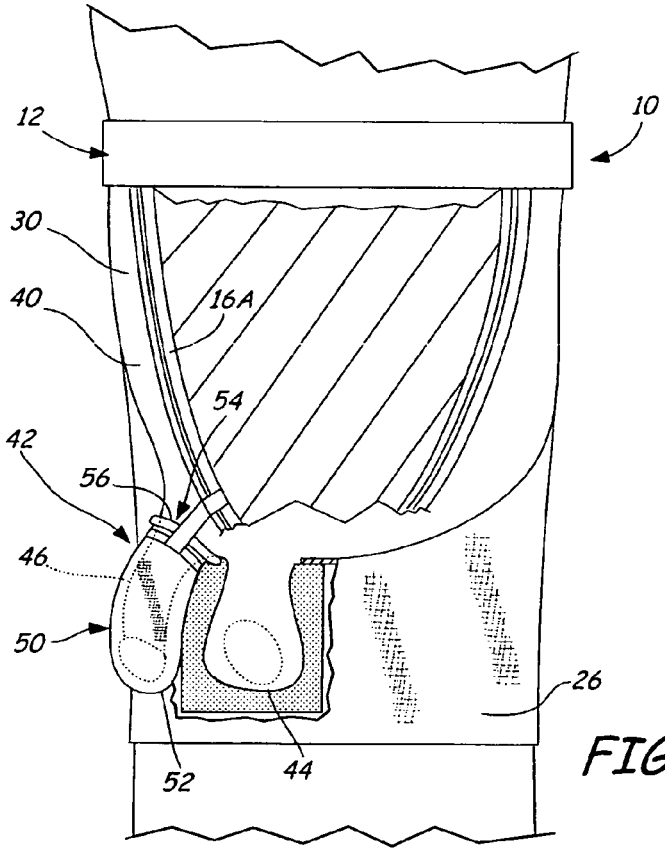
FIG. 11 is a side view of a wearer having the undergarment system of the present invention in place.

The opening 30, at the front of the garment system, (with or without leggings) on the male, permits the penis and scrotum to be unobstructed, and protrude from the leg strap sections 14A and 16A, as is illustrated in FIG. 11, for example.

Figure 6:
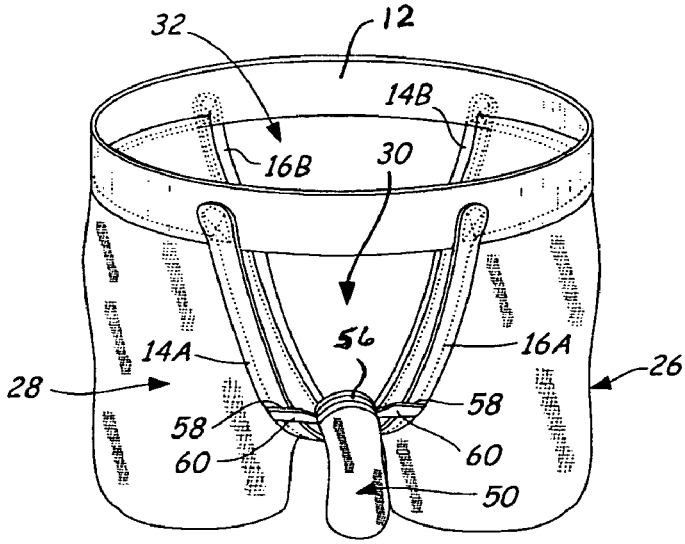
FIG. 6 is a perspective view of the garment system showing a covering to cover the penis.
Figure 7:
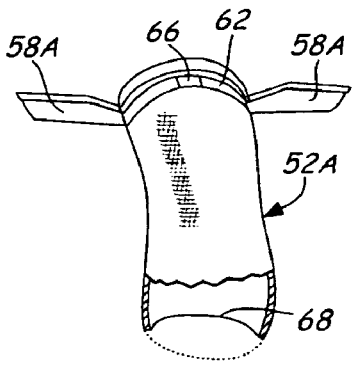
FIG. 7 is a perspective view of a first form of a covering shown in FIG. 6.

A covering sleeve or pouch for the penis itself, while permitting the other organs to be naturally suspended is shown in FIGS. 6 and 11, and variations of the support therefore in FIGS. 7–10. The showings are schematically made, not necessarily to scale. They are for illustrative purposes.

The penis covering would help to keep the head of the penis soft by protecting it from possible abrasive areas the penis may otherwise come in contact with. The penis covering also helps to keep the hair around the scrotum area from becoming intertwined with the foreskin that may surround the head of the penis, thus providing increased comfort.

A different option for this front triangular open area is to have a pouch that would cover and protect the scrotum but not cover the penis. Another option for the front triangular open area is to have an attachable covering for only the penis. The penis covering could be tight or loose fitting around the penis, depending on the preference of the wearer and would be available in various lengths and materials.

The penis covering is selectively closed on the outer end, open on the outer end or has a flap type of outer end covering for the opening which would allow the penis to be passed through the outer end of the covering when desired for urination or for any other reason the wearer may have to want to access the penis, without removing the penis covering from the basic waistband, leg opening band structure.

As shown in FIG. 11, the stomach or abdomen 40 of a wearer of the underwear can protrude from the opening 30 between the strap sections 14A and 16A (FIG. 11 shows the strap section 16A only) and the genitalia indicated generally at 42 may also protrude from the opening 30. The leggings 24 and 26 can cover the upper leg portions, entire leg or entire leg and foot with only the leg portion 26 being illustrated in FIG. 11. Although specific leg portion lengths have been mentioned, it is intended that leg portions having any type of length to be included within the present invention. The opening 30 permits the scrotum 44 of the genitalia 42 and the penis 46 to protrude outwardly from the leggings 24 and 26.

In a preferred form of the invention, a covering 50 encloses, or at least partially encloses the penis 46. The covering 50 can be made of any suitable material. The covering 50 slips over the penile shaft and is formed as a sleeve like sack or pouch 52 that has an open end 54 with a base ring structure 56 that can comprise a ring made of the rolled fabric of the pouch or an inserted separate ring, in various shapes of suitable size that will rest against the skin of the lower abdomen 40. The purpose of the ring 56 is to allow for easier insertion of the penis into the penis covering.

The ring 56 can be secured to the leg strap portions permanently or in a removable manner using well known fasteners or fastening systems. Various ways of attaching the pouch 52 in place using the ring 56 are illustrated in FIGS. 6–10. In the basic form, the pouch 52 can be a totally enclosed tube of fabric, latex/condom type lined fabric which is liquid tight, with a closed end as shown in FIG. 11. The ring base 56 is shown rolled in fabric, provided with attachment straps 58 that fit onto the leg strap sections 14A and 16A with suitable fasteners 60, such as snaps, lacing, buttons, Velcro® (hook and loop) fasteners or the like. Alternatively, the fastening can be done with a strap or band 58A shown in FIG. 7. A band of fabric or other material 62 is wrapped around the sack or pouch 52A, and can be permanently attached in place such as by stitching, and then the straps 58A are used for securing the pouch 52A to the front leg strap sections. The band 62 can be any desired material, and can wrap around the pouch 52A after the pouch has been put in place on the wearer's body. The band 62 is then held in its wrap-around condition with a fastener 66 at the front. The fastener 66 also can be an adjustable fastener of some type such as a Velcro® (hook and loop) fastener, or snaps or even a small non-protrusive buckle. In this form of the invention, the pouch 52 can have an open end 68. It would not be enclosed as shown in FIG. 11.

Figure 8:
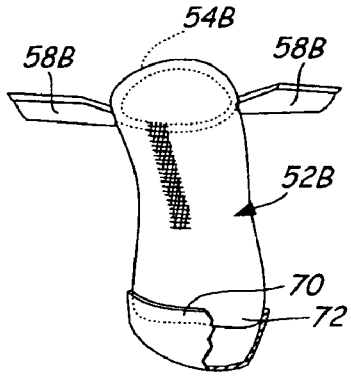
FIG. 8 is a perspective view of a second form of a covering shown in FIG. 6.

As illustrated in FIG. 8, the pouch 52B is provided with sewn on attachment straps 58B that are positioned at the base or ring portion 54B of the pouch 52B. The ring portion 54B can be a roll formed by rolling the open end of the pouch. The straps 58B then can have ends that are attached to the leg strap sections 14A and 16A as shown with fasteners 60.

In this form of the invention the pouch 52B is shown to have a fold over flap 70, that can be folded back to expose an opening to the interior 72 for opening the end portion of the pouch 52B for urination or other functions. Flap 70 is shown only schematically, and is broken away in FIG. 8 for illustrative purposes.

Figure 9:
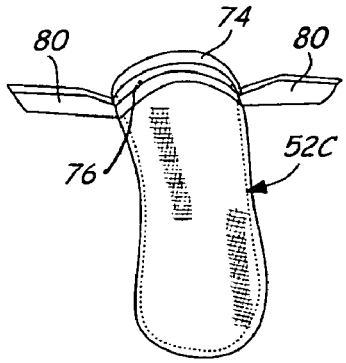
FIG. 9 is a perspective view of a further modified form of the covering shown in FIG. 6.

A preferred form of holding the sac 52C in place is shown in FIG. 9, as well as more fully illustrated in FIG. 10. In this case the pouch 52C is attached in a preferred manner, and can be formed to be enclosed fully, or open at the end, or with a flap 70. In this form of the invention, the pouch 52C has a sewn in ring area 74 at its base end that lies against the abdomen of the user. The ring is of suitable stiffness to maintain an opening at the end of the sac.

A retaining structure 73 is shown more fully in FIG. 10. The ring 74 has the material of the pouch folded around and fastened (such as by stitching) back on itself to hold the ring 74 in place and to maintain the end opening as desired. In order to retain the pouch 52C in place, an outer slip ring assembly 76 is further provided. The slip ring assembly 76 includes a ring 78 of suitable material that is generally of smaller size than the ring 74. The ring 78 is provided with attachment straps 80, that in turn have end portions with fasteners 82 that are securable to the leg strap sections 14A and 16A.

Once the pouch 52C has been slipped into place, up against the abdomen skin, the ring 74 can be held tightly against the skin by putting on the retainer ring 78 and fastening the straps 80 tautly with suitable fasteners 82 or the retainer ring assembly could be permanently attached to the basic structure on straps 14A and 16A.

FIG. 12 shows a front view of the retainer structure 73 in partially schematic form, with leggings broken away to show the extra pads 38 in position as well. The covering or pouch 52, 52A–52C can be made of a form holding type of material that would form a semi-rigid shell, or made with materials that were flexible in one direction and not the other, for example.

The region above the rings 74 and 78 is open, as indicated at 30 in FIG. 12. If desired, of course, the area above the penis could be covered loosely or with removable materials.

Figure 13:
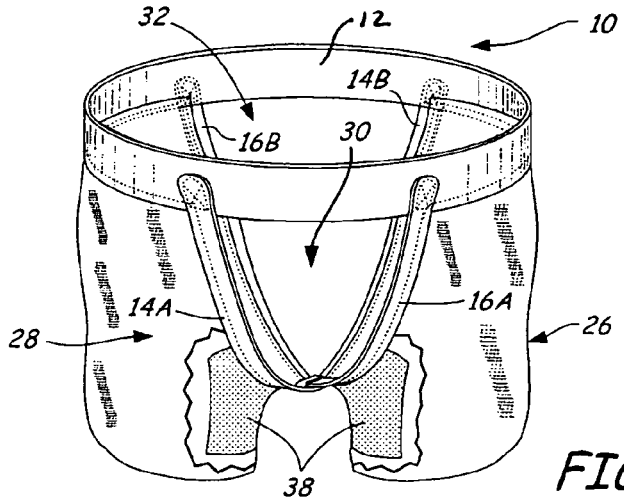
FIG. 13 is a perspective view of the undergarment with portions broken away showing padding in place.

FIG. 13 is a perspective view with portions broken away showing the pads 38 in position, in the crotch area, for absorbent, isolative, and other purposes.

The material that is used for the penis pouch 52, and the other forms of it, can be a material that would serve as a barrier, much like a condom that could be a latex or latex lined material. It can be liquid absorbing material, or other material that is comfortable. If a front panel is used to cover the opening 30, for example in connection with a female use, these panels can be made of a type of cellophane, plastic sheet or latex/condom type material to prevent transfer of diseases. It also can be slightly elastic (latex like), so that it can be made to allow penetration into orifices of the body from the exterior.

The basic waistband and leg straps would be sufficient to hold the edges of this stretch material, if the material was used as a covering for items penetrating the vagina or other orifices from the exterior.

Although the present invention has been described with reference to preferred embodiments, workers skilled in the art will recognize that changes may be made in form and detail without departing from the spirit and scope of the invention.

What is claimed is:

1. A support structure for an undergarment onto which portions of the undergarment are attached and which cover portions of the human body, the support structure comprising:

a waistband having a forward side and a rearward side;

at least two leg straps fastened at spaced apart positions to the forward side of the waistband, the leg straps extending downwardly from the forward side of the waistband, the leg straps intersecting and joining in a crossover crotch section proximate a crotch area of the human body, each leg strap extending upwardly and fastened at spaced apart positions to the rearward side of the waistband, the leg straps forming a generally v-shaped forward opening defined by the forward side of the waistband, the at least two legs straps that extend downwardly from the forward side of the waistband and the intersecting crossover crotch section;

leggings attached to the waistband and to the leg straps, wherein the leggings surround each leg of the human body; and a pair of pads proximate the crotch area, wherein each pad extends from the crossover crotch section and down each interior side of each legging.

2. The structure of claim 1 and further comprising a genitalia covering attached to the leg straps for covering the forward V-shaped opening.

3. The structure of claim 1 and further including a sleeve-like pouch of a size to receive a male penis strap that secures the pouch to the leg straps at a forward side of the support structure.

4. The structure of claim 1 further including a pouch for receiving a male penis, the pouch being supported on the leg straps; and a base ring adhered to the leg strap, and the pouch being secured to the base ring.

5. The structure of claim 4 wherein the ring is detachably attached to the pouch.

6. The structure of claim 4 wherein the ring is made of a self-supporting material.

7. The structure of claim 4 and further including a second ring of a size to surround the pouch proximate the base ring, the second ring including fasteners for supporting the second ring on the leg straps.

8. The structure of claim 2 and further including a flexible panel extending over the V-shaped opening and attached to the leg straps.

9. The structure of claim 8 where in the flexible panel is also elastic.

10. The structure of claim 1 and further including a panel extending between the leg straps at the rearward side of the waistband.

* * * * *